United States Patent [19]

Schrag

[11] Patent Number: 4,893,385

[45] Date of Patent: Jan. 16, 1990

[54] MEMORIAL VAULT APPARATUS

[76] Inventor: Truman F. Schrag, 2460B Hamlet La., Colorado Springs, Colo. 80918

[21] Appl. No.: 300,306

[22] Filed: Jan. 23, 1989

[51] Int. Cl.[4] ..... A61G 17/00; E04H 13/00

[52] U.S. Cl. ..... 27/35; 27/7; 27/29; 52/134; 52/136

[58] Field of Search ..... 52/128, 133, 134, 135, 52/136, 137, 129, 103, 104, 685–689, 719; 27/7, 35, 27, 2, 8, 1, 28, 23, 29; 405/128, 129

[56] References Cited

U.S. PATENT DOCUMENTS

| | | | |
|---|---|---|---|
| 892,458 | 7/1908 | Sparks | 52/134 X |
| 3,925,944 | 12/1975 | Pickel | 52/134 |
| 3,348,280 | 10/1967 | Myers | 27/2 |
| 3,529,730 | 9/1970 | Thompson | 52/134 X |
| 3,581,452 | 6/1971 | Jalbert | 52/133 |
| 3,898,718 | 8/1975 | Eubank | 27/35 |
| 3,940,894 | 3/1976 | Nunes | 52/129 |
| 3,978,627 | 9/1976 | Booth . | |
| 3,986,308 | 10/1976 | Jones . | |
| 4,073,100 | 2/1978 | DiGiovanni, Jr. . | |
| 4,521,999 | 6/1985 | Flanagan | 52/103 |
| 4,614,066 | 10/1986 | Koppenberg . | |
| 4,727,632 | 3/1988 | Yearsley | 27/35 |

FOREIGN PATENT DOCUMENTS

| | | | |
|---|---|---|---|
| 2361922 | 6/1975 | Fed. Rep. of Germany | 52/136 |
| 2631140 | 1/1977 | Fed. Rep. of Germany | 52/134 |
| 771314 | 10/1980 | U.S.S.R. | 52/134 |

*Primary Examiner*—Richard E. Chilcot, Jr.
*Attorney, Agent, or Firm*—Henderson & Sturm

[57] ABSTRACT

A memorial vault apparatus for human cremated remains which includes a concrete slab having a top level surface. A first set of elongated parallel cylindrical pipes are supported on top of the level surface with each adjacent pair of pipes being equidistantly spaced from each other. Each of the pipes of the second set of pipes are perpendicular to each of the pipes of the first set of pipes to form a grid work for receiving vaults in the spaces formed between the first and second set of pipes. A saddle connector is provided for attaching each of the pipes of the second set of pipes to each of the pipes of the first set of pipes. This saddle structure has a first semi-circular surface thereon in abutment with the top of one of the first set of pipes and a second semi-circular surface in abutment with the bottom of one of the second set of pipes and the saddle structure is adhesively cemented to the pipes at the point which the saddle structure abuts the pipes.

6 Claims, 2 Drawing Sheets

MEMORIAL VAULT APPARATUS

TECHNICAL FIELD

The present invention relates generally to a memorial vault system and more particularly to such a system which uses a top loaded grid work maze to store and keep track of the location of vaults containing urns of cremated human remains.

BACKGROUND ART

The availability of land for cemeteries is becoming more and more limited as time goes on. That is one reason why cremation of human remains is becoming more popular.

Interment by placing cremated human remains in urns and then placing such urns in front loaded vaults is quite common. While this system requires the use of much less space, it does require construction of an expensive above ground building and there are practical limits of how high the vault storage structure can be. For example, it would be unacceptable for the vault to be so high that the front thereof cannot be easily viewed from floor level. Consequently, there is a need to solve the aforementioned problems.

DISCLOSURE OF THE INVENTION

The present invention relates to a memorial vault apparatus for human cremated remains which includes a concrete slab having a top level surface. A first set of elongated parallel cylindrical pipes are supported on top of the level surface with each adjacent pair of pipes being equidistantly spaced from each other. Each of the pipes of the second set of pipes are perpendicular to each of the pipes of the first set of pipes to form a grid work for receiving vaults in the spaces formed between the first and second set of pipes.

A saddle connector is provided for attaching each of the pipes of the second set of pipes to each of the pipes of the first set of pipes. This saddle structure has a first semi-circular surface thereon in abutment with the top of one of the first set of pipes and a second semi-circular surface in abutment with the bottom of one of the second set of pipes. The saddle structure is adhesively cemented to the pipes at the points at which the saddle structure abuts the pipes.

Cylindrical vaults are disposed in the spaces formed in the grid work and an aggregate material, such as sand or gravel, covers all of the concrete slab, the grid work and the vaults.

A wall extends upwardly from one side of the concrete slab for attaching memorial plaques thereto for the purpose of identifying the persons buried in the vaults.

A cap puller is provided for selectively removing the cap from one or more of the vaults at a time before such vaults are permanently sealed.

An object of the present invention is to provide an improved memorial vault system for storing cremated human remains.

Another object of the present invention is to provide an economical way to construct a memorial vault system which provides a dignified permanent interment.

A still further object of the present invention is to provide a memorial vault system which can easily be expanded if desired.

A still further object of the present invention is to provide a top loaded memorial vault system which uses a grid work or maze to ensure easy location of each vault disposed therein.

A still further object of the present invention is to provide a vault which is completely waterproof and vandal resistant.

A still further object of the present invention is to provide a cap puller for a vault which will allow a second urn to be placed in the vault at a later date if desired.

Other objects, advantages, and novel features of the present invention will become apparent from the following detailed description of the invention when considered in conjunction with the accompanying drawings.

BEST MODE FOR CARRYING OUT THE INVENTION

Figure 1:
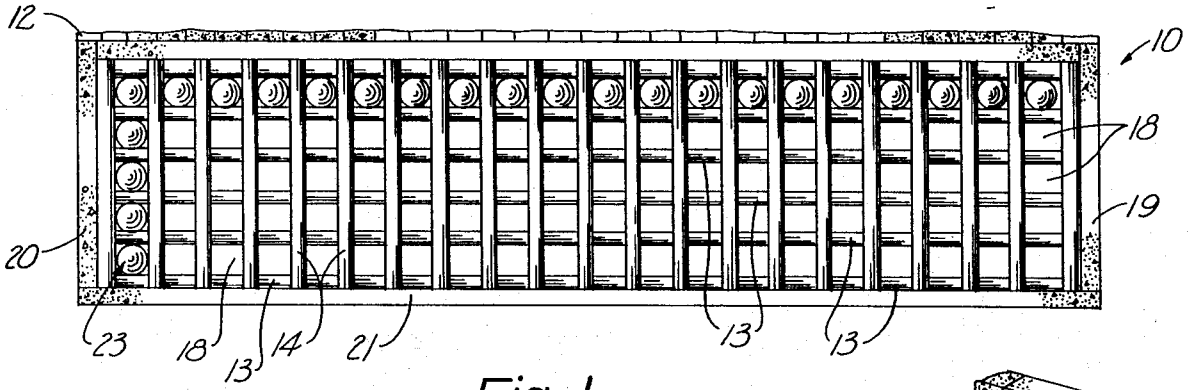
FIG. 1 is a top plan view of the memorial vault system shown before sand is placed on top of the grid work and vaults in order to show the basic construction thereof.
Figure 2:
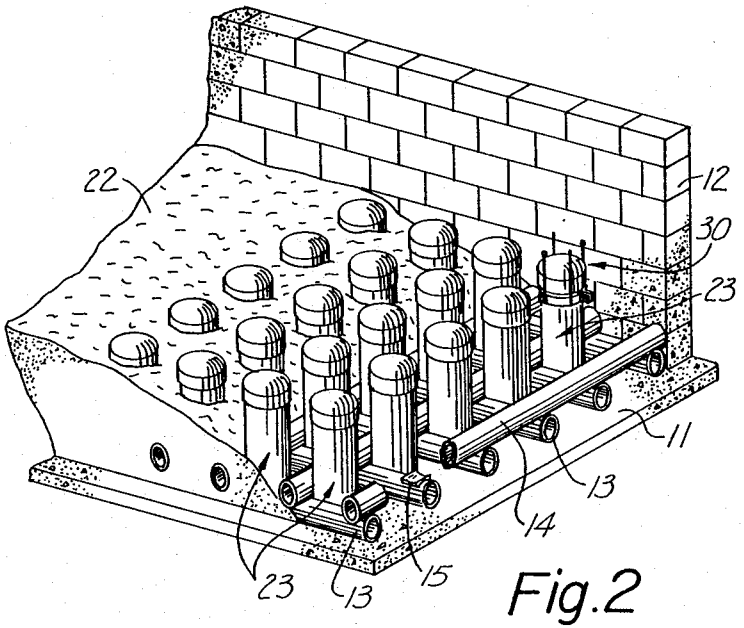
FIG. 2 is a perspective view of a portion of the present invention shown with part of the sand on top of the grid work and vaults and with one of the vaults having the cap puller installed thereon in readiness to pull the cap therefrom.

Referring now to the drawings wherein like reference numerals designate identical or corresponding parts throughout the several views, FIG. 1 shows a memorial vault system (10) constructed in accordance with the present invention. Referring to FIG. 2, a concrete slab (11) has a front wall (12) constructed of stone, brick or some aesthetically pleasing material for placing memorial plaques thereon for memorializing those persons buried in the vault.

Figure 3:
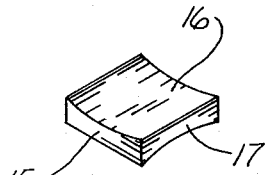
FIG. 3 is a perspective view of a saddle block of the present invention for attaching the lower set of parallel pipes to the upper set of parallel pipes in FIG. 2.

A first set of parallel pipes (13) formed of PVC material or the like are placed on top of the level concrete slab (11). A second set of parallel pipes (14) are placed on the top of the first set of parallel pipes (13) and are perpendicular to the first set of parallel pipes (13). These pipes (13) and (14) are connected together at each place the pipes (13) and (14) cross by the use of a saddle block (15) shown in FIGS. 2 and 3 having a first semi-cylindrical surface (16) thereof for abutting the pipes (14) and a second semi-cylindrical shaped surface (17) on the bottom thereof for resting on top of the pipes (13).

An adhesive is placed on the semi-cylindrical surfaces (16) and (17) to permanently cement the grid work together so that the pipes (13) and (14) will not move from the position shown in FIGS. 1 and 2. This will cause spaces (18) to be formed between and among the pipes (13) and (14) as is clearly shown in FIG. 1. Side walls (19) and (20) and a rear wall (21) can be added to help contain the sand (22) which is poured over the grid work (13) and (14) and the vaults (23).

Figures 4, 5, 6, 7, 8, 9, 10:
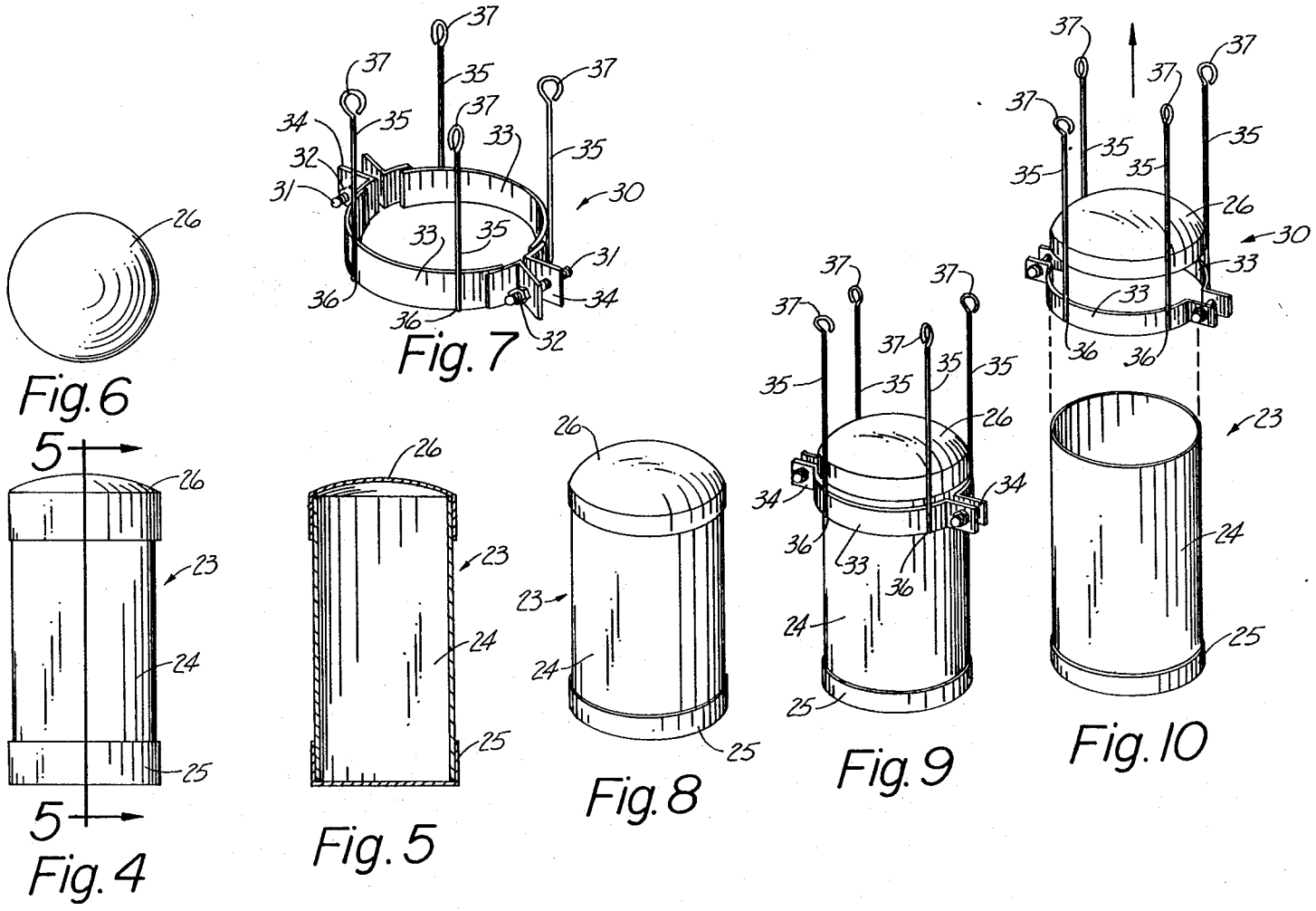
FIG. 4 is a side elevational view of one of the vaults shown in FIG. 2.
FIG. 5 is a cross sectional view taken along line 5—5 of FIG. 4.
FIG. 6 is a top view of the vault of FIG. 4.
FIG. 7 is a perspective view of a cap puller for removing the top cap of the vault shown in FIG. 4.
FIG. 8 is a perspective view of one of the vaults.
FIG. 9 is a perspective view of one of the vaults with the cap puller attached thereto in readiness to pull the off the top thereof.
FIG. 10 shows the cap being removed from a vault with the cap puller of FIG. 7.

Referring to FIGS. 4 and 5, the vaults (23) include a cylindrical portion (24) and a bottom cap (25) which is permanently cemented to the cylindrical portion (24). A top cap (26) is initially, frictionally fitted over the top of the cylinder (24) as is clearly shown in FIG. 4 and 5.

When the vault system (10) shown in FIGS. 1 and 2 is initially built, the top caps (26) will all merely be frictionally disposed on top of the cylinders (24), but they will still make the vaults (23) waterproof. When it is desired to remove the cap (26), the cap puller (30) shown in FIG. 7 is utilized by first removing threaded nuts (31) from bolts (32) so that the first and second semi-circular brackets (33) can be separated. Then the semi-circular brackets (33) are placed in the position shown in FIG. 9 and the threaded nuts and bolts (31) and (32) are again attached to the flanges (34), through holes therein to the position shown in FIG. 9.

Upstanding rods (35) are welded at one end (36) to the semi-circular brackets (33) and have loops (37) at the other end thereof. When it is desired to place an urn of human remains in the vault (23), the cap puller (30) is used by attaching something to the loops (37), such as a chain, cable or a specially made bracket (not shown) in order to pull equally from all four of the rods (35) in a jerking fashion upwardly to cause the cap (26) to move from the position shown in FIG. 9 to the position shown in FIG. 10. This can be done either with the vault in the position in the grid work between pipes (13) and (14) as shown in FIG. 2, or it can be removed from the grid work when the cap (26) is removed. Then the entire vault is placed back in the grid work in its proper position.

The cap (26) can then be placed back and held in place by friction to hold the one urn or it can be permanently cemented in place with an adhesive or the like if there is no desire to place another urn of human remains therein. In a situation where it is desired to place two urns of human remains in the same vault, for example through the wishes of a husband and wife, the cap (26) can be merely frictionally replaced during the interment of one spouse and then after the interment of the other spouse, the cap (26) can be permanently cemented in place so that the vault (23) cannot be opened.

Accordingly, it will be appreciated that the preferred embodiment shown herein does indeed accomplish the aforementioned objects. Obviously many modifications and variations of the present invention are possible in light of the above teachings. It is therefore to be understood that, within the scope of the appended claims, the invention may be practiced otherwise than as specifically described.

I claim:

1. A memorial vault apparatus for human cremated remains comprising:

burial vaults;

a concrete slab having a top level surface;

a first set of elongated parallel cylindrical pipes supported on said top level surface, each adjacent pair of pipes being equidistantly spaced from each other and each pipe of the first set having a top and a longitudinal axis;

a second set of elongated parallel cylindrical pipes, each adjacent pair of pipes in said second set being equidistantly spaced from each other, each of the pipes of the second set of pipes being perpendicular to each of the pipes of the first set of pipes and each of the pipes of the second set having a bottom and a longitudinal axis, means for connecting each of the pipes of the second set of pipes to each of the pipes of the first set of pipes, for forming a grid work among said first and second set of pipes for forming spaces to receive said burial vaults, each of said connecting means comprising a saddle means having a first semi-cylindrical surface thereon in abutment with the top of one of the first set of pipes, said first semi-cylindrical surface being formed about an axis parallel to the longitudinal axis of the pipe of said first set of pipes on which it abuts and a second semi-cylindrical surface thereon in abutment with the bottom of one of the second set of pipes, said second semi-cylindrical surface being formed about an axis parallel to the longitudinal axis of the pipe of said second set of pipes which it abuts the bottom thereof, each of said saddle means being adhesively cemented to the pipes which each saddle means abuts;

cylindrical vaults being disposed in said spaces formed in said grid work, a sealed bottom on each vault being in abutment with the top of said level surface, each of said vaults also having a tightly fitting cylindrical cap on the top thereof; and an aggregate material such as sand or gravel covering all of the concrete slab, grid work and vaults.

2. The apparatus of claim 1 including a wall extending upwardly from one side of said concrete slab for attaching memorial plaques thereto for identifying the persons buried in said vaults.

3. The apparatus of claim 1 including a cap puller apparatus for selectively removing the cap from one or more of said vaults, said cap puller apparatus comprising:

a first semi-circular bracket disposed around one side of one of the cylindrical vaults, the radius of curvature of said semi-circular bracket being substantially the same as the radius of curvature of the exterior cylindrical surface of each cylindrical vault;

a second semi-circular bracket disposed around the other side of said one cylindrical vault;

means for releasably attaching said first and second semi-circular brackets together at the ends thereof for holding the two brackets in a tight fitting but slideable position around said one cylindrical vault below the cap thereof; and means attached to said first and second semi-circular brackets for pulling upwardly thereon to force the cap off of the top of said one vault.

4. The apparatus of claim 3 wherein said attaching means comprises apertured flanges on the ends of said first and second semi-circular brackets and threaded fasteners extending through the apertures in said flanges.

5. The apparatus of claim 3 wherein said pulling means comprises a plurality of upwardly extending rods welded to said semi-circular brackets.

6. The apparatus of claim 5 wherein each of said rods has a loop the top thereof.

* * * * *